US005079046A

United States Patent [19]

Kessler

[11] Patent Number: 5,079,046

[45] Date of Patent: Jan. 7, 1992

[54] POMPON

[75] Inventor: Brian D. Kessler, Youngstown, Ohio

[73] Assignee: Maui Toys, Inc., Youngstown, Ohio

[21] Appl. No.: 641,956

[22] Filed: Jan. 16, 1991

[51] Int. Cl.[5] ..... D04D 7/06

[52] U.S. Cl. ..... 428/4; 28/147; 116/63 P

[58] Field of Search ..... 428/4, 23; 28/147; 116/63 P; 404/9

[56] References Cited

U.S. PATENT DOCUMENTS

| | | | |
|---|---|---|---|
| 1,003,895 | 9/1911 | Gasthoff | 428/23 |
| 1,991,602 | 2/1935 | Dernehl | 428/23 |
| 2,275,290 | 3/1942 | Dreyer | 428/212 |
| 2,893,149 | 7/1959 | Reece et al. | 206/423 X |
| 3,457,134 | 7/1969 | Karkoska | 428/23 X |
| 3,484,070 | 12/1969 | Horodko et al. | 428/7 X |
| 3,711,360 | 1/1973 | Kent | 428/31 X |
| 3,846,212 | 11/1974 | Rodermund et al. | 428/4 |
| 4,055,840 | 10/1977 | Uchytil et al. | 428/4 X |
| 4,221,500 | 9/1980 | Garrett | 428/23 X |
| 4,287,647 | 9/1981 | Rodermund et al. | 428/4 X |
| 4,369,215 | 1/1983 | Offen et al. | 428/4 |
| 4,488,372 | 12/1984 | Lowen | 428/4 X |
| 4,490,419 | 12/1984 | Sliva | 428/4 |
| 4,798,386 | 1/1989 | Berard | 428/11 X |
| 4,886,687 | 12/1989 | Malott | 428/4 |

*Primary Examiner*—Henry F. Epstein
*Attorney, Agent, or Firm*—Browdy and Neimark

[57] ABSTRACT

A pompon has flexible streamers formed of transparent plastic, preferably PET, in which the transparent flexible plastic contains a fluorescent dye such that when the plastic is cut to form the streamers, the cut edges provide a glowing effect in the presence of light.

3 Claims, 1 Drawing Sheet

FIG. 1
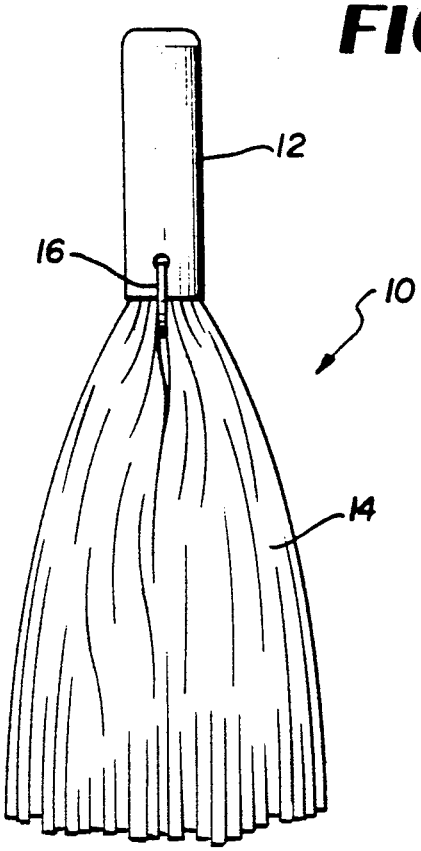
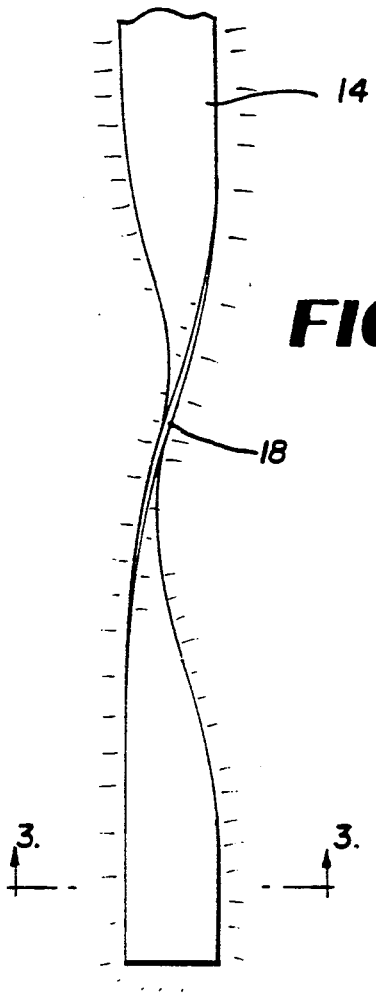
FIG. 2
FIG. 3
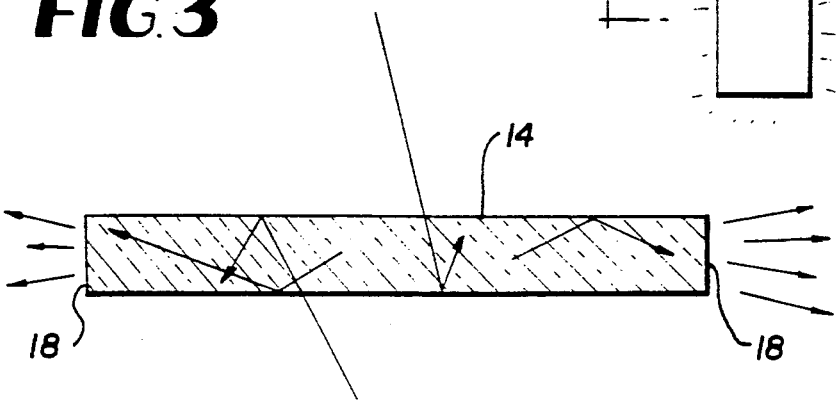

POMPON

FIELD OF THE INVEMTION

The present invention relates to pompons and more particularly to pompons presenting an unusual visual display, namely a "glowing" or "neon edge" effect at cut edges of the pompon strips or streamers.

BACKGROUND OF THE INVENTION

Pompons are of course well known in the prior art. They commonly consist of a handle element with a plurality of strips or streamers of decorative material, such as feathers, strips of paper, strips of flexible plastic or strands of colorful yarn. These devices are grasped and shaken to provide a visual display, such as at sporting events.

Various modifications of the typical pompons have been proposed in order to provide a better visual display for one reason or another. Thus, the Offen et al U.S. Pat. No. 4,369,215 discloses a finger held pompon in which the "shakers can have a glossy appearance so that the same will catch and reflect light". Uchytil et al U.S. Pat. No. 4,055,840 discloses a pompon shaped safety warning device intended as an emergency reflector and which has streamers 16 which are "shiny strips of relatively thin flexible, glossy reflective material, for example, silvered Mylar". Malott U.S. Pat. No. 4,886,687 discloses a light reflecting pompon type device.

As indicated above, the streamers which often form the visual part of pompons have been known to be formed of plastic strips. Rodermund et al U.S. Pat. No. 4,287,647 discloses a process for making pompons and mentions that plastics are suitable materials for pompon strip "foils" and further that the foils may be dyed. Insofar as is known, however, no one has previously used any fluorescent, phosphorescent or dayglow dyes or pigments in the manufacture of such strips or streamers, although fluorescent dyes have been used in toys and in golf balls (Berard U.S. Pat. No. 4,798,386).

Regarding the general use of fluorescent pigments in plastics, the Kirk-Othmer Encyclopedia of Chemical Technology (3rd Ed., Vol. 6, page 612) states:

> Fluorescent pigments or dyes depend upon their ability to absorb light at one wavelength and to remit it in a narrow intense band at a longer wavelength . . . . The dyes used include the rhodamines, which emit pink, and aminonaphthalimides which are bright greenish yellow. To obtain maximum effect, the dyes are dissolved in brittle resins at low concentrations. The colored resins are then ground to powders and used as pigments. The brightness of such a combination far exceeds that of any pigment alone.
>
> Fluorescent dyes do not have lightfastness. Their use in plastics is confined to the lower temperature resins, vinyls, polyethylene, and acrylics, at maximum temperatures of 200° C.

And from Volume 14, pp. 546–547:

> There are many types of luminescent materials, some of which require a special source of excitation such as an electric discharge or ultraviolet radiation.

> Daylight-fluorescent pigments, in contrast, require no artificially general energy. Daylight, or an equivalent white light, can excite these unique materials not only to reflect colored light selectively, but to give off an extra glow of fluorescent light, often with high efficiency and surprising brilliance . . . .
>
> Daylight-fluorescent pigments, with a few exceptions, consist of particles of colorless resins containing dyestuffs that not only have color but are capable of intense fluorescence in solution. The resin is truly a solvent for the dyes. For example, in one resin system, a thermoplastic molten resin is formed containing the dye. Upon cooling to room temperature, the resin mass becomes very brittle. It is then pulverized to the proper fineness . . . .
>
> A fluorescent substance is one that absorbs radiant energy of certain wavelengths and, after a fleeting instant, gives off part of the absorbed energy as quanta of longer wavelengths. In contrast to ordinary colors in which the absorbed energy degrades entirely to heat, light emitted from a fluorescent color adds to the light returned by simple reflection to give the extra glow characteristic of a daylight-fluorescent material . . . .

Important Dyestuffs for Daylight-Fluorescent Pigments

| Name | CAS Registry Number | Colour Index (CI) Number | Manufacturer |
|---|---|---|---|
| Rhodamine B | [81-88-9] | Basic Violet 10 | BASF |
| Rhodamine F5G | [989-38-8] | Basic Red 1 | BASF |
| Xylene Red B | [3520-42-1] | Acid Red 52 | Sandoz Chemical |
| Fluorescent Yellow Y | [2478-20-8] | Solvent Yellow 44 | L. B. Holliday |
| Maxillon Brilliant Flavine 10GFF | [12221-8-2] | Basic Yellow 40 | CIBA-GEIGY |
| Alberta Yellow[a] | | Solvent Yellow 135 | Day-Glo Color |
| Potomac Yellow | [61902-43-0] | Solvent Yellow 160:1 | Day-Glo Color |
| Macrolex Fluorescent Yellow 10GN | | Solvent Yellow 160:1 | F. Bayer |

[a]Soluble only in strong solvents such as dimethyl formamide and in some molten resins.

And from Vol. 14, pp. 564,565:

> The brilliance of daylight-fluorescent colors leads to their use for the decoration and enhancement of a wide range of products. Children's plastic toys, plastic containers, and many other consumer items are colored with fluorescent pigments to heighten their appeal . . . .
>
> Most manufacturers of fluorescent pigments offer special products for coloring thermoplastic molding resins . . . . Low- and high-density polyethylene, high-impact and general purpose polystyrene, ABS, and various acrylic polymers are best suited for these pigments. The pigment, 1–2% of the total weight of the plastic, is added either as a dry-blended material or first formulated into a color-concentration pellet which is blended into the uncolored resin before molding into a finished article.

| Approximately Equivalent Commercial Pigment Colors[a] | | | | | |
|---|---|---|---|---|---|
| Day-Glo A-Series[b] | | Lawter B-3500 Series[c] | | Radiant R-105 Series[d] | |
| A-17-N | saturn yellow | B-3539 | lemon yellow | R-105-810 | chartreuse |
| A-18-N | signal green | B-3545 | green | R-1-5-811 | green |
| A-16-N | arc yellow | B-3515 | gold-yellow | R-105-812 | orange-yellow |
| A-15-N | blaze orange | B-3514 | yellow-orange | R-105-813 | orange |
| A-14-N | fire orange | B-3513 | red-orange | R-105-814 | orange-red |
| A-13-N | rocket red | B-3534 | red | R-105-815 | red |
| A-12 | neon red | B-3530 | cerise red | R-105-816 | cerise |
| A-11 | aurora pink | B-3522 | pink | R-105-817 | pink |
| A-21 | corona magenta | B-3554 | magenta | R-103-G-118 | magenta |
| A-19 | horizon blue | B-3556 | vivid blue | R-103-G-119 | blue |

[a]Similar colors are listed horizontally but are not exact color matches.
[b]Thermoplastic pigments for use in paint, screen ink, plastisol, gravure ink, paper coatings, and many other applications.
[c]Multipurpose pigments for paint, gravure ink, screen ink, paper coatings, plastisol, candles, plastics, and many other applications.
[d]Multipurpose pigments for paint, screen ink, paper coatings, plastisol, gravure ink, plastics, and many other applications.

As noted above and in spite of such known prior art, pompons with streamers having glowing edges are not known.

SUMMARY OF THE INVENTION

It is an object of the present invention to provide a pompon having an exciting and novel visual display.

It is another object of the present invention to provide a pompon having streamers with edges having a "glowing" or "neon edge" appearance, thereby giving the effect that the streamers are internally lighted.

The above and other objects are obtained according to the present invention by providing transparent plastic sheets or films containing one or more fluorescent, luminescent, phosphorescent or "dayglow" dyes or pigments, hereinafter sometimes generally referred to as "fluorescent dyes". When the plastic sheets or films are cut to create the streamers, the cut edges glow, i.e. they have a "glowing" or "neon edge" appearance or quality. While not wishing to be bound by this theory, it is believed that light is apparently absorbed through the flat surfaces of the streamers, is amplified by the fluorescent dye and allowed to escape through the cut edges, providing a glowing effect which is very pleasing to the eye.

BRIEF DESCRIPTION OF THE DRAWINGS

The above and other objects and the nature and advantages of the present invention will become apparent, and the present invention will be more clearly understood from the following detailed description taken in conjunction with the accompanying drawings, in which:

FIG. 1, is a front or side view of an embodiment of a pompon in accordance with the present invention;

FIG. 2, is a enlargement of one of the streamers of the pompon of FIG. 1 in accordance with the present invention; and FIG. 3, is a cross-sectional view, further enlarged, of the pompon streamer of FIG. 2 taken along lines 3—3 of FIG. 2.

DETAILED DESCRIPTION OF THE PREFERRED EMBODIMENTS

Referring to FIG. 1, a pompon 10 according to the present invention is disclosed having a handle 12 and a plurality of flexible plastic streamers 14 extending from one end of the handle 12. In the illustrated embodiment, the streamers are held by a suitable holding element 16, although it will be understood that the nature of the handle and the streamer holding element and their precise constructions do not form part of the present invention, and such elements may take any operative form.

A novel feature of the pompon of the present invention is the use of a transparent plastic material containing an appropriate fluorescent dye or pigment for the streamers 14, such fluorescent dye-containing material having the ability to glow at its cut edges in the presence of light as illustrated by cut edge 18 in FIG. 2. The streamer 14 is shown in cross-section in FIG. 3 where light emerging from the two cut edges 18 is schematically illustrated. Light enters through the flat surfaces of the streamers 14 and is transmitted to the cut edges 18, producing a luminescent or "neon edge" glowing effect very noticeable by and pleasing to the human eye. Furthermore, interesting visual effects are created when the pompon is then shaken, particularly in sunlight.

Two examples of pompons in accordance with the present invention were made starting with films of polyethylene terephthalate (PET), respectively of thicknesses of one mil and two mils, containing pink fluorescent dye. When the plastic film was cut into strips to form the streamers 14, the cut edges 18 were found to glow in a bright pink color in the presence of light.

It is to be understood that the streamers 14 can be made of any suitable transparent, flexible plastic containing any fluorescent, phosphorescent or luminescent dye or pigment which produces the aforementioned effect, which is easily tested in a routine fashion. Thermoplastic polyesters, especially PET, are particularly suitable as the selected plastic, although any suitably transparent and flexible plastic can be used, such as polyvinylidene chloride (saran) and transparent polyolefins such as transparent polyethylene and transparent polypropylene and these are formed into films of a thickness in the range of about 0.7–5 mils. Suitable dyes which produce the desired glowing or "neon edge" effect are LQC-R412-1 (Trans Red), LQC-Y254-1 (Trans Yellow), LQC-G277 (Trans Green), Solvent Yellow 98 (xanthane dye), Solvent Green 5 (Perylene dye), Solvent Orange 63, Vat Red 41 and mixtures thereof, it being understood that these dyes must be routinely tested for compatibility with the selected plastic.

In a second embodiment, some of the streamers are provided with a glow-in-the dark dye or pigment so that the pompons can be used to provide a special effect in darkness.

The foregoing description of the specific embodiments will so fully reveal the general nature of the invention that others can, by applying current knowledge, readily modify and/or adapt for various applications such specific embodiments without departing from the generic concept, and therefore such adaptations and modifications are intended to be comprehended within the meaning and range of equivalents of the disclosed embodiments. It is to be understood that the phraseology or terminology herein is for the purpose of description and not of limitation.

What is claimed is:

1. In a pompon of the type having a handle and a plurality of flexible streamers extending from said handle, the improvement wherein said streamers are formed of a plastic film material cut into strips having streamer edges, wherein said plastic film material comprises a transparent, flexible plastic containing a luminescent dye which provides a glowing effect to the streamer edges.

2. The pompon of claim 1 wherein said transparent flexible plastic is polyethylene terephthalate.

3. The pompon of claim 1 wherein said film has a thickness of 0.7–5 mils.

* * * * *